US008513558B2

(12) United States Patent
Nazeri

(10) Patent No.: US 8,513,558 B2
(45) Date of Patent: Aug. 20, 2013

(54) ELECTROMECHANICAL CIRCUIT BREAKER

(75) Inventor: Christopher Nazeri, Prevessin (FR)

(73) Assignee: Secheron S.A., Satigny (CH)

( * ) Notice: Subject to any disclaimer, the term of this patent is extended or adjusted under 35 U.S.C. 154(b) by 211 days.

(21) Appl. No.: 13/232,105

(22) Filed: Sep. 14, 2011

(65) Prior Publication Data

US 2012/0067849 A1 Mar. 22, 2012

(30) Foreign Application Priority Data

Sep. 20, 2010 (EP) ..... 10009917

(51) Int. Cl.
*H01H 9/44* (2006.01)

(52) U.S. Cl.
USPC ..... 218/23; 335/201; 218/40

(58) Field of Classification Search
USPC ..... 335/35, 172, 201; 218/40, 23–27; 200/147
See application file for complete search history.

(56) References Cited

U.S. PATENT DOCUMENTS 4,404,443 A * 9/1983 Coynel et al. ..... 218/23
5,872,495 A * 2/1999 DiMarco et al. ..... 335/35
5,886,606 A * 3/1999 Tosaka et al. ..... 335/172
7,417,520 B2 * 8/2008 Kralik ..... 335/201
7,518,477 B2 * 4/2009 Martin et al. ..... 335/201
7,671,711 B2 * 3/2010 Suzuki ..... 335/6
7,915,985 B2 * 3/2011 Schmitz et al. ..... 335/201
2008/0030289 A1 2/2008 Kralik

FOREIGN PATENT DOCUMENTS

DE 10117346 A1 11/2002

OTHER PUBLICATIONS

European Search Report, Dated Mar. 9, 2011, in Application No. EP 10009917.

* cited by examiner

*Primary Examiner* — Truc Nguyen
(74) *Attorney, Agent, or Firm* — Young & Thompson

(57) ABSTRACT

An electromechanical circuit breaker for establishing and breaking the current in a main circuit includes a fixed contact element and a moving contact element, which in a first position are in electrical contact with each other for carrying the current of the main circuit, the moving contact element being adapted to be displaced to a second position in which it is separated from the fixed contact element so that the current in the main circuit is cut off. The circuit breaker is provided with a blow-out device including a magnetizing coil traversed by a magnetizing current for producing a magnetic field adapted to drive an arc generated by the separation of the two contact elements into an arc extinction element.

12 Claims, 8 Drawing Sheets

ELECTROMECHANICAL CIRCUIT BREAKER

This invention relates to electromechanical circuit breakers especially but non-exclusively adapted for the protection of DC installations such as traction networks including rail vehicles.

Such networks have typically a nominal voltage of 750 to 3000 V. The circuit breaker is for instance used for the interruption of heavy currents in case of a short circuit somewhere in the installation. It has, however, also numerous other industrial applications.

Such known electromechanical circuit breakers comprise a fixed contact element co-operating with a movable contact element. Under normal conditions these elements are in contact with each other and current in a main circuit is conducted between the elements. When breaking the current, the moving contact element is displaced by means of some type of electromechanical actuator, increasing the physical distance between these contact elements which will create an electrical arc between the two contact elements.

In order to make the breaking of the current effective this electrical arc has to be extinguished. This is usually accomplished by making use of a so called arc-chute of a known type into which the arc is directed by a force related to the magnetic field generated by the main circuit. Inside this arc-chute, the arc will be split up in a multitude of smaller arcs which will ultimately lead to the final break down of the conduction over the separated contact elements.

For this purpose, circuit breakers of this type are usually provided with a so-called blow-out device which can be of the electromagnetic type, which means that an electromagnetic force is used to drive the electrical arc into an arc extinguishing device such as an arc-chute.

The advantage of using the main current to generate a magnetic field is that it is reversed when the current is reversed and the resultant force on the arc is always in the same sense. This means that current through the circuit breaker can be interrupted in either sense (i.e. the circuit breaker is not polarity sensitive).

The electromagnetic force for displacing the arc into the arc-chute in a DC circuit breaker is in general a function of the current value. There is a particular problem when the current to be interrupted is very low. In this case the generated force will not be sufficient to displace the arc into the arc-chute.

A known solution to solve this problem is to use a permanent magnet to generate a magnetic field that is sufficient to move the arc at low currents. Usually, the permanent magnet is arranged so that the magnetic field is uniform and essentially perpendicular to the direction of the current and so that the resultant force on the arc is directed to push the arc into the arc chute. However, if the current changes direction, the resultant force on the arc will also change direction and push the arc in a direction opposite to the arc chute. The circuit breaker is thus polarity sensitive.

One object of the present invention is to provide an improved design of a blow-out device for an electromechanical circuit breaker which eliminates the inconveniences of the known devices. In particular, a main aim of the present invention is to provide a circuit breaker that can break very low current whilst able to break current in either direction.

The object of the present invention is an electromechanical circuit breaker intended to establish and break the current in a main circuit and comprising a fixed contact element and a moving contact element which in a first position are in electrical contact with each other for carrying the current of the main circuit, said moving contact element being adapted to be displaced to a second position in which it is separated from the fixed contact element so that the current in the main circuit is cut off, the circuit breaker being provided with a blow-out device comprising a magnetising coil traversed by a magnetising current for producing a magnetic field adapted to drive an arc generated by the separation of said two contact elements into an arc extinction means, the blow-out device comprising electrode means electrically connected to the magnetising coil and adapted to cooperate with said arc in such a manner that the latter generates said magnetising current in the magnetising coil, the magnetic field for driving the arc being generated by the action of said arc, characterised by the fact that the blow-out device further comprises magnetic means for producing a magnetic field radially directed with respect to the arc and adapted to generate a force on the arc in order to displace the latter so that the arc is forced to contact the electrode means.

These features allow obtaining a circuit-breaker having a very precise and secure functioning and a high efficiency even when breaking lower currents. Moreover, high solidity and longevity and a lower cost price can be obtained The blow-out device is favourably provided with a magnetising coil and a magnetising circuit comprising at least two arms, said magnetic field for driving the arc being generated at least partially between said two arms.

These features allow the generation of a magnetic field which is particularly well adapted to drive the arc into the arc extinguishing device, whatever the direction and strength of said arc, thus obtaining a high breaking performance and security.

Other features, objects, uses and advantages of this invention will be apparent from the dependent claims and from the description which follows with reference to the accompanying drawings forming part thereof and wherein:

Figure 6A:
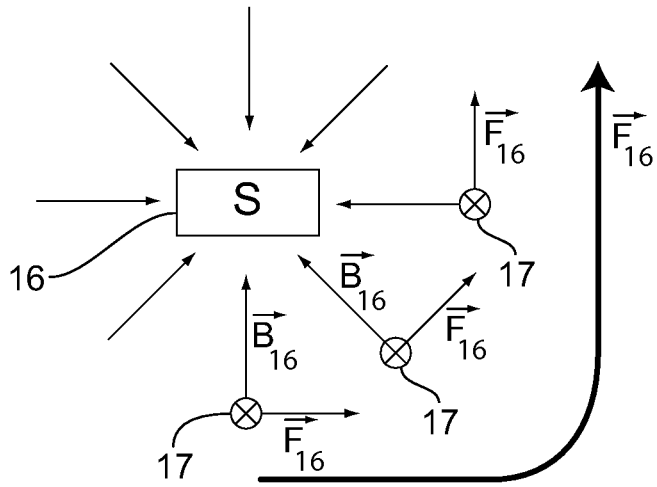
Figure 6B:
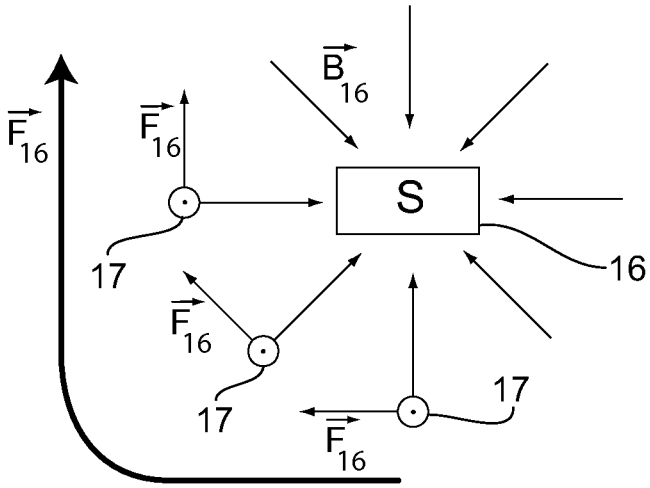
Figure 6C:
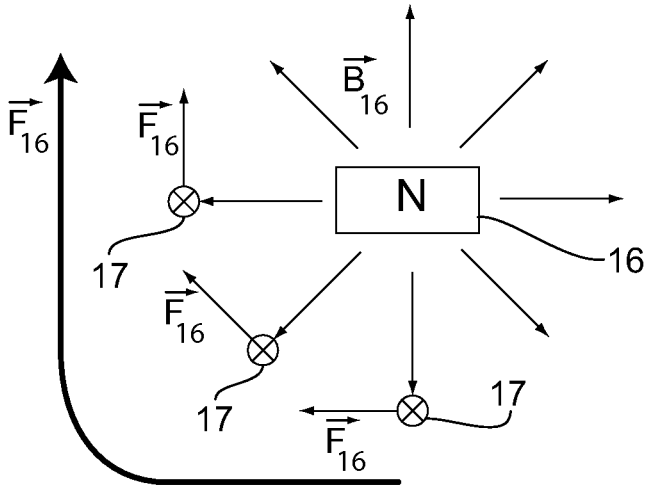

FIGS. 6*a*, 6*b* and 6*c* illustrate schematically the displacement of the arc into the blow-out device according to the invention depending on the direction of the current and orientation of the permanent magnets.

Figure 7A:
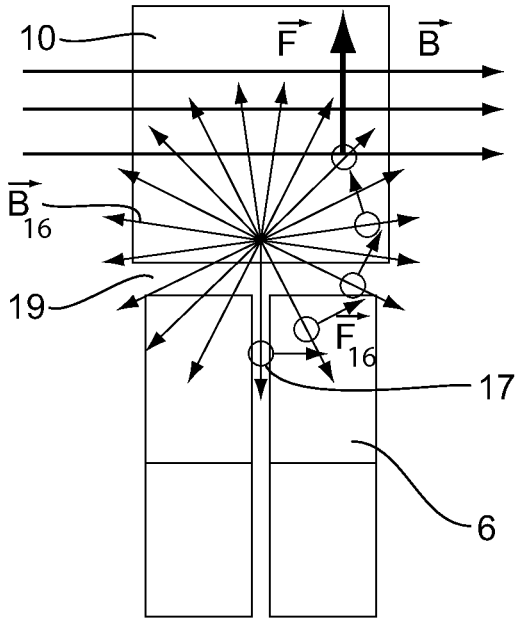
Figure 7B:
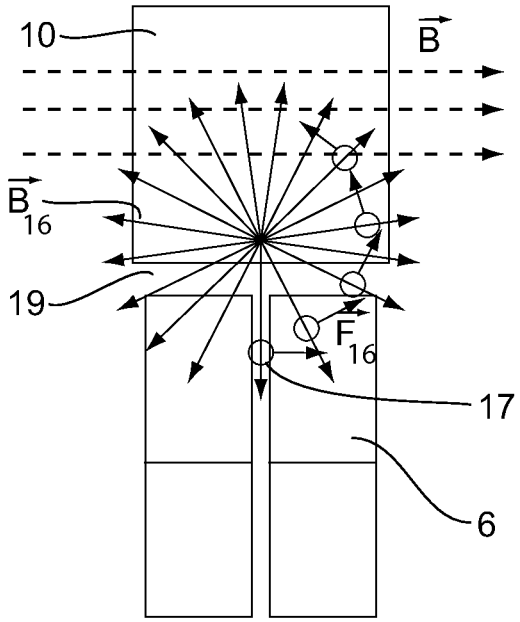

FIG. 7*a*, 7*b* illustrate schematically the displacement of the arc into the blow-out device according to the invention, in respectively a normal case and a limit case.

Figure 7C:
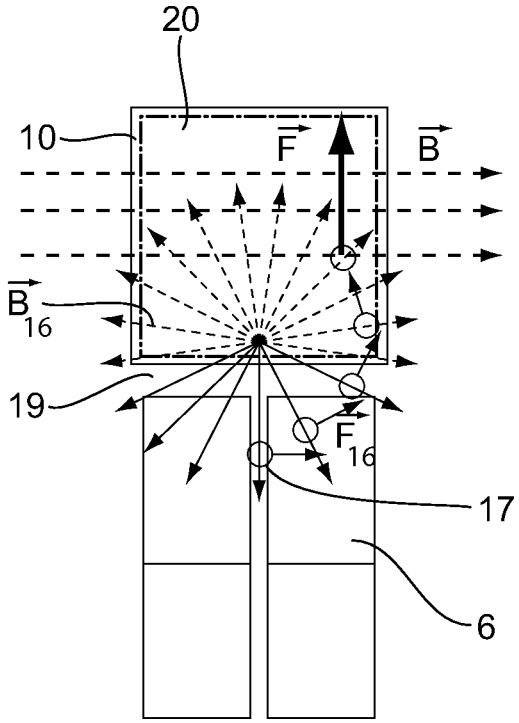

FIG. 7*c* illustrates schematically the displacement of the arc into the blow-out device according to a variant of the invention.

Figure 1:
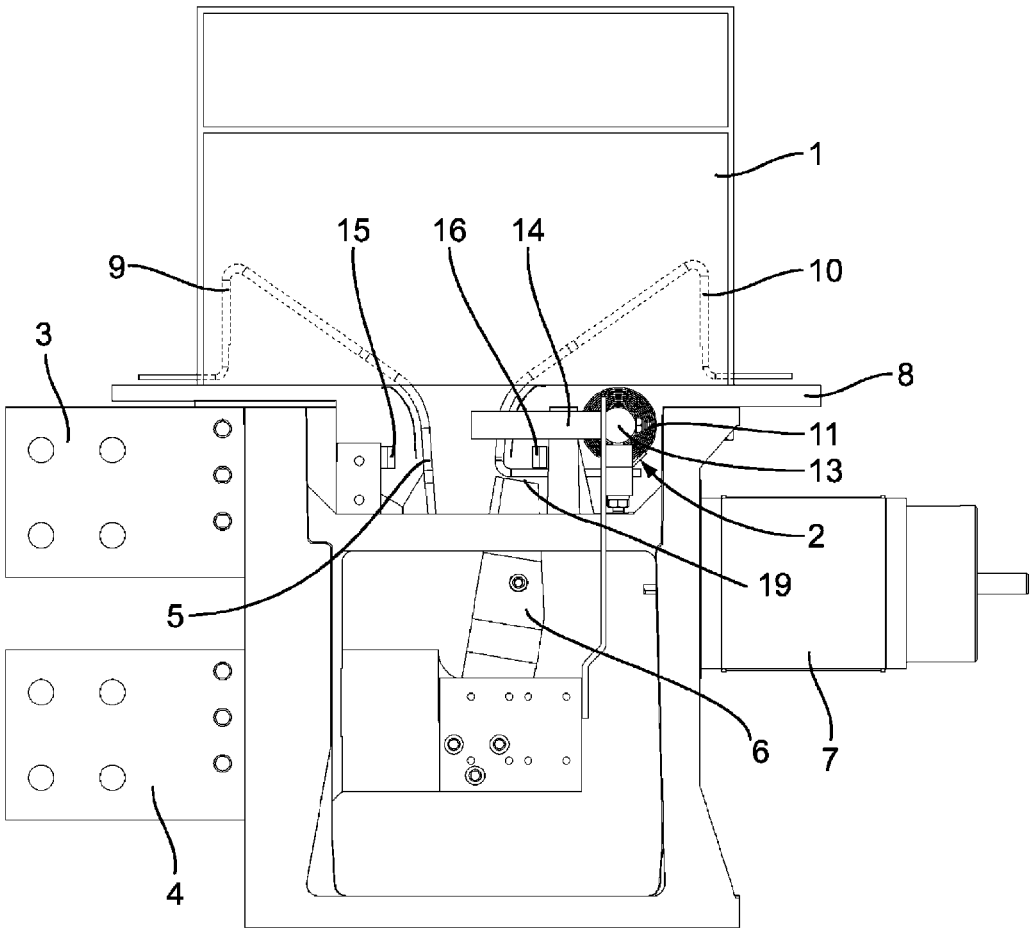
FIG. 1 shows a circuit breaker according to the invention with a blow-out device and an associated arc-chute.

FIG. 1 shows schematically and in a general way a circuit breaker according to the invention with a blow-out device 2 and an associated arc-chute 1. This arc-chute 1 is of a conventional design and will not be further described in this context. The main current path passes through a first contact bar 3 to a fixed mechanical contact element 5, through an associated moving mechanical contact element 6 and a second contact bar 4. Under normal conditions these contact elements 5, 6 are in electrical contact with each other carrying the main current. The current through the contact elements 5, 6 could flow in either direction at the moment when the circuit breaker is activated.

The movement of the mechanical contact element 6 is controlled by means of an actuator 7 creating the needed physical movement for opening the electrical contact 6 by e.g. pulling the contact elements 5, 6 apart and increasing the distance between the elements 5, 6. This actuator 7 is of a conventional design and will not be further described in this context.

A typical situation in which the circuit breaker is activated is when there appears for some reason a short circuit somewhere in the main circuit in which the circuit breaker is connected.

Such a short circuit could considerably increase the current over nominal values which could of course damage components and equipment in said main circuit.

In order to minimise the effect of such a short circuit it would therefore be of interest to completely break the current as quickly as possible which is thus accomplished by means of the circuit breaker.

The circuit breaker should, however, also be able to break lower currents which cause a bigger design problem.

Detection means well known to the person of ordinary skill in the art (not shown) are e.g. arranged in the main circuit and aimed to detect conditions under which the main current should be cut off. Such a condition may consist in an increase of the current which could be the result of a short circuit. Co-operating control means well known to the person of ordinary skill in the art (not shown) send a signal to the actuator 7 of the circuit breaker which will then displace the moving contact element 6 to break the current. The circuit breaker could however also be actuated manually or by using an ordinary control signal sent to the actuator 7 without detection of anomalous conditions.

Figure 2:
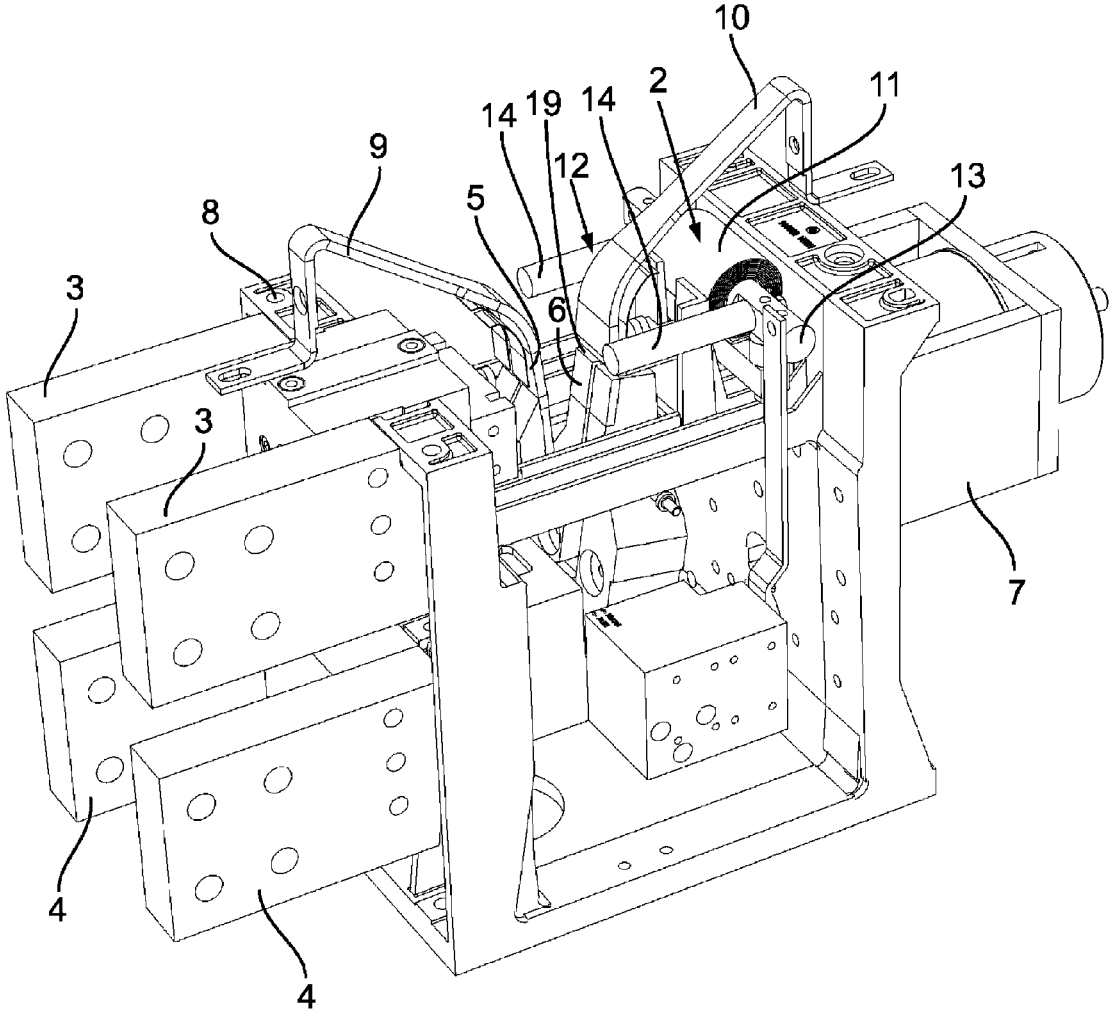
FIG. 2 shows in another view the arrangement of the blow-out device according to FIG. 1.

FIG. 2 shows in another view the arrangement of the blow-out device according to FIG. 1. In this figure, the arc-chute 1 is not shown, but the upper generally flat surface 8 that is the support surface for the associated arc-chute 1 is indicated.

The blow-out device 2 comprises a first arc runner 9 mounted over the fixed contact element 5 and electrically connected to the latter and a second arc runner 10 mounted on the top of the moving contact element 6 and electrically connected to the latter. There is a gap 19 between the moving contact element 6 and the second arc runner 10.

The blow-out device 2 further comprises a magnetising coil 11 electrically connected between the movable contact element 6 and the second arc runner 10 and generating a magnetic field B in a magnetic circuit 12 comprising a core 13 and two arms 14. The core 13 and arms 14 of the magnetic circuit 12 are suitably made of iron. The said magnetic circuit 12 is described here as an example, and other suitable arrangements well known to the person of ordinary skill in the art can clearly be used in the blow-out device 2 according to the invention.

Figure 5:
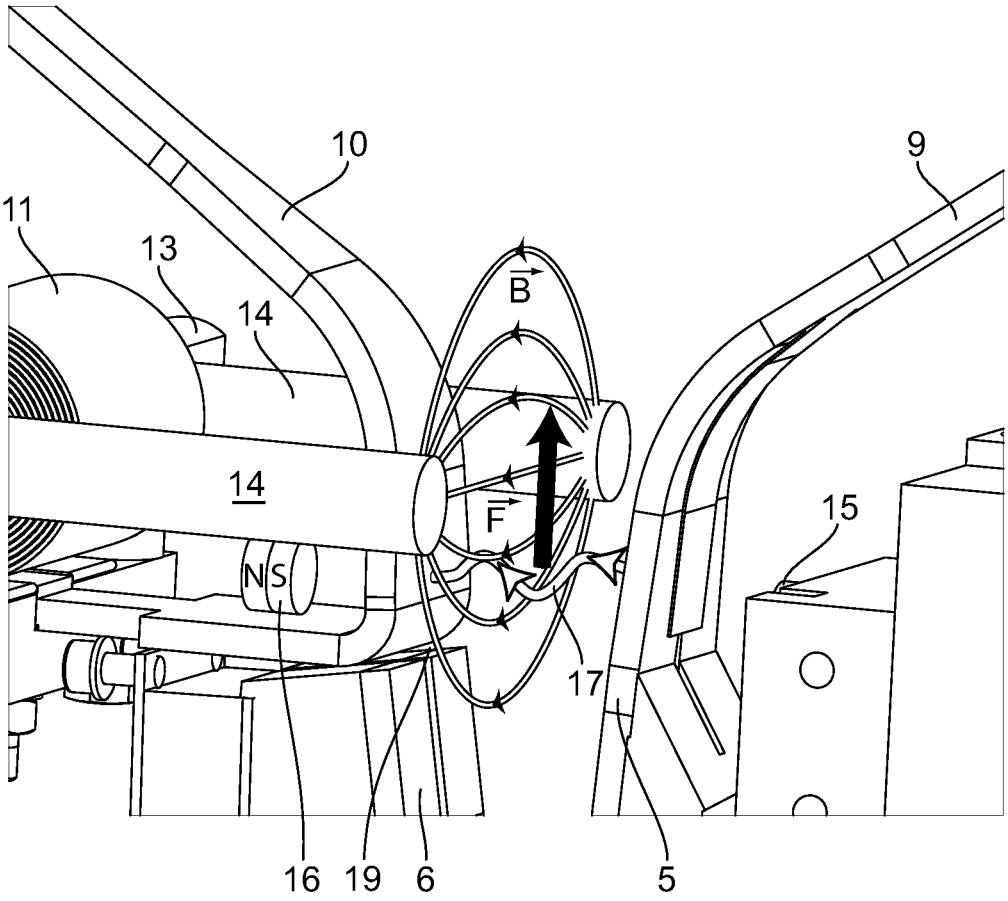
FIG. 5 shows an electric arc in a second phase in the circuit breaker and the blow-out device according to FIGS. 1 and 2, with the arc flowing in the same direction as in FIG. 4.

When activated by a current the magnetising coil 11 generates a magnetic field B through the arms 14 of the magnetic circuit 12, as illustrated in FIG. 5.

The activating current for the magnetising coil 11 according to the above is generated automatically during the breaking sequence without the input of energy from the outside of the circuit breaker.

The blow-out device 2 according to the invention also comprises at least two permanent magnets 15, 16 arranged respectively behind the first and the second arc runners 9, 10. Preferably, the magnets 15, 16 are not in contact with their respective arc runner 9, 10 but rather placed on some suitable support, for example made of plastic, to protect the said magnets 15, 16 in case of overheating of the arc runners 9, 10 during a short circuit.

Figure 3:
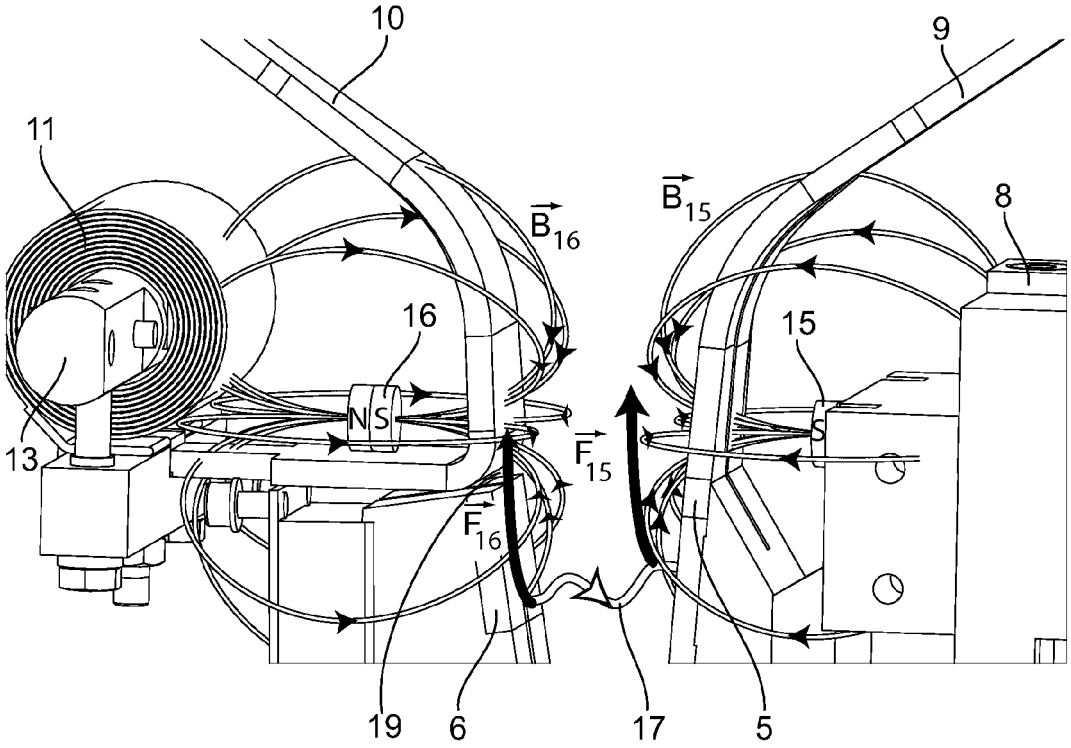
FIGS. 3 and 4 show an electric arc in a first phase in the circuit breaker and the blow-out device according to FIGS. 1 and 2, with the arc flowing in one direction in FIG. 3 and in the opposite direction in FIG. 4.
Figure 4:
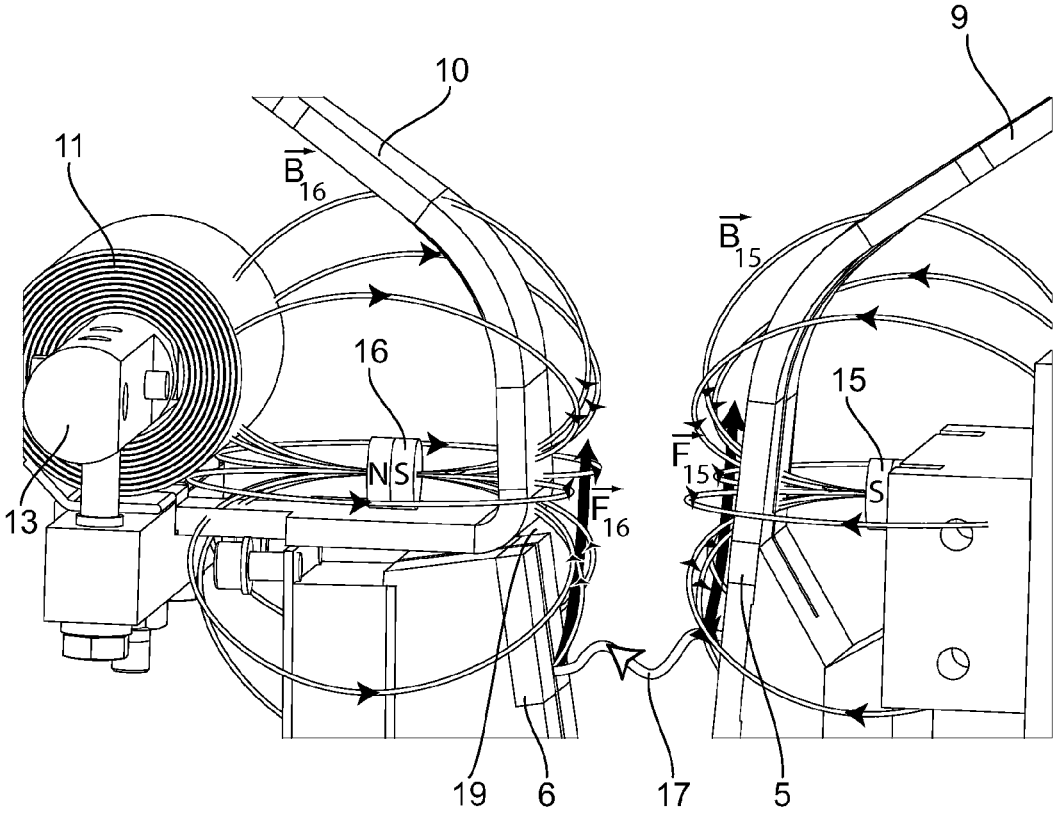

Each of the permanent magnet 15, 16 creates a magnetic field $B_{15}$ respectively $B_{16}$ in the space between the contact elements 5, 6 as illustrated in FIGS. 3 and 4.

Under normal conditions, the fixed and moving contact elements 5, 6 are in electrical contact carrying the full main current (this situation is not illustrated).

If now some predefined conditions are detected in the main circuit which according to the applied strategy should result in a cut off of the main current, then the actuator 7 which could be of electromechanical type acting on the moving contact element 6 will receive a control signal. As a result the moving contact element 6 is withdrawn from the fixed contact element 5.

The main current will however not drop to zero immediately due to the fact that an electrical arc 17 is created between the fixed and the moving contact elements 5, 6 as illustrated in FIGS. 3 and 4. The direction of the arc 17 depends on the direction of the main current: FIGS. 3 and 4 show respectively the said arc 17 between the contact elements 5, 6 flowing in a first direction and in the opposite direction. The challenge for a circuit breaker is now to turn out this electrical arc 17 as quickly as possible in order to limit possible damages in the main circuit.

As described above, this type of circuit breaker uses an arc-chute 1 into which the electrical arc 17 is forced in order to split it up and finally extinguish it. In the figures, the arc-chute 1 is physically arranged in the upper part of the figure.

A driving force F which will get the arc into the arc-chute is created by the interaction between the arc 17 and the magnetical field B generated by the magnetising coil 11 and the magnetic circuit 12 in the space around the contact elements 5, 6. This driving force F has then to be directed upwards in FIGS. 3, 4 and 5. This driving fore F should be strong enough for the arc 17 to pass the gap 19 between the moving contact element 6 and the second arc runner 10. However, as this force F depends on the intensity of the current at the time of the breaking, in case of lower current, this force may be too weak to force the arc 17 through the gap 19 and into the arc-chute 1. As will be explained below, the blow-out device 2 according to the invention eliminated this drawback and allow a complete and secure breaking of the current even in case of lower current.

FIGS. 3 and 4 illustrate the situation immediately after the withdrawal of the moving contact element 6 from the fixed contact element 5 when an electric arc 17 is created between the said contact elements 5, 6. In FIG. 3, the arc is flowing in a first direction while in FIG. 4, the said arc 17 is flowing in the opposite direction.

The permanent magnets 15, 16 of the blow-out device 2 are arranged so that their respective magnetic fields $B_{15}$, $B_{16}$ extends radially with respect to the arc 17. In FIGS. 3, 4, **6*a* and 6*b*, the permanent magnets 15, 16 are oriented with their south pole S pointing towards the space between the contact elements 5, 6. As will be explained below, this is an arbitrary choice: the magnets have to be in an opposing sense in order to generate the suitable radial magnetic field but the invention will work the same with the permanent magnets having their north pole N pointing towards the space between the contact elements 5, 6**.

The magnetic fields $B_{15}$, $B_{16}$ create then each a force $F_{15}$, $F_{16}$ on the arc 17 already from the start, adapted to force each a foot 18 of the arc 17—now in contact with the fixed respectively the moving contact elements 5, 6—to come into contact with the first respectively second arc runners 9, 10 at an early stage.

These forces $F_{15}$, $F_{16}$ are Laplace Force. Precisely, each of these forces $F_{15}$, $F_{16}$ is perpendicular to both the direction of the current and the lines of the magnetic fields $B_{15}$ respectively $B_{16}$ eventually pushing the arc 17 in a circular motion which direction is determined according to the right-hand rule.

The force $F_{16}$ due to the permanent magnet 16 placed behind the second arc runner 10 and acting on the foot of the arc 17 in contact with the moving contact element 6 is particularly illustrated in FIGS. 6*a* and 6*b*. In FIG. 6*a*, the arc 17 flows perpendicularly to the plan of the paper away from the reader while in FIG. 6*b*, the arc 17 flows perpendicularly to the plan of the paper towards the reader. Thus, in FIG. 6*a*, the arc 17 is pushed first to the right then up, while in FIG. 6*b* the arc 17 is first pushed left and then up.

FIG. 6*c* illustrates that the orientation of the poles of the permanent magnets (here the permanent magnet 16 placed behind the second arc runner 10) is not important. As illustrated, the north pole N of the permanent magnet 16 points towards the space between the contact elements 5, 6. The resultant force $F_{16}$ on the arc 17 is still directed upwardly and will push the arc 17 up towards the arc chute 1.

Once the arc 17 comes into contact with the arc runners 9, 10 as illustrated in FIG. 5, it itself activates the magnetising coil 11 generating a magnetic field B through the arms 14 of the magnetising circuit 12. The direction of the magnetic field B depends on the direction of the current and the magnetising coil 11 and the magnetic circuit 12 are conformed so that this magnetic field B creates a force F that will force the arc 17 into the arc-chute 1. This force F has to be directed upwardly in FIG. 5.

Once in the arc-chute 1, the arc 17 will be split up in a multitude of smaller arcs which will ultimately lead to the final break down of the conduction over the separated contact elements 5, 6.

This arrangement of the magnets 15, 16 according to the invention works for both directions of the main current at the moment of breaking. Moreover, the permanent magnets 15, 16 provide an additional force to help the arc 17 pass the gap 19 between the second arc runner 10 and the moving contact element 6 and activate the magnetising coil 11 even in case of low current. This allows the circuit breaker according to the invention to efficiently break even small current. The circuit breaker according to the invention will break very low current as long as it is high enough for the magnetic field B generated by the magnetising coil 11 and proportional to said current to be greater than the magnetic field $B_{15}$, $B_{16}$ generated by the permanent magnets 15, 16.

FIG. 7*c* illustrates a variant of the invention. If the current is extremely low, it can happen that the arc 17, pushed from the contact elements 5, 6 to the arc runners 9, 10 by the permanent magnets 15, 16 is so low that the magnetic field B created by the magnetising coil 11 between the arms 14 is weaker that the magnetic fields $B_{15}$, $B_{16}$ generated by the permanent magnets 15, 16. The arc 17 will then continue to spiral around the axis of the magnets 15, 16 and won't be pushed into the arc chute 1. This extreme case is schematically illustrated in FIG. 7*b*, while a non-extreme case is illustrated in FIG. 7*a*. In both figures, the current is perpendicular to the plan of the paper and directed towards the reader. To ensure that the arc 17 is pushed in the arc chute 1 even in this extreme case, the circuit breaker according to a variant of the invention further comprises steel plates 20 mounted each behind the first and second arc runners 9, 10. These steel plates 20 will reduce the strength of the upper part of the magnetic fields $B_{15}$, $B_{16}$ due to the permanent magnets in the space between the contact elements 5, 6 (this is schematically represented by dotted lines in FIG. 7*c*). Hence, as illustrated in FIG. 7*c*, even in case of extremely low current, the arc 17 will be pushed up from the contact element 5, 6 to the arc runners 9, 10, because the magnetic fields $B_{15}$, $B_{16}$ aren't reduced in front of said contact element 5, 6. Once in contact with the arc runners 9, 10 the arc 17 will activate the magnetising coil 11 generating a magnetic field B between the arms 14. The magnetic field B would be lower that the magnetic field $B_{15}$, $B_{16}$, but due to the steel plates 20, the magnetic fields $B_{15}$, $B_{16}$ are reduced in front of the arc runners 9, 10 and so the resultant force F on the arc 17, upwardly directed in FIG. 7*c*, will push the arc 17 into the arc-chute 1 where it will be extinguished.

Of course, the embodiments described above are in no way limiting and can be the subject of all desirable modifications within the framework defined by the claims.

The circuit breaker could be provided with more than one moving and fixed contact element.

The blow-out device could comprise only one permanent magnet 16 arranged behind the second arc runner 10 on top of the movable element 6. The magnetic field $B_{16}$ will then create a force $F_{16}$ to force the foot 18 of the arc 17 in contact with the said movable element 6 to pass the gape 19 and come into contact with the second runner 10. Once the said foot 18 is in contact with the said second runner 10, it activates the magnetising coil 11 generating a magnetic field B through the arms 14. This magnetic field B creates in turn a force F that pushes the arc 17 into the arc chute 1 as explained above.

The design of the magnetic circuit 12, of the arms 14 and of the core 13 could be chosen differently.

The blow out device 2 could be provided with more than one coil, the latter being however set in parallel coupling with the arc or part of the arc.

The blow-out device 2 could be provided with more that one permanent magnet behind each arc runner.

The circuit breaker described above has a very precise and secure functioning and is particularly adapted to break lower current. The permanent magnets provide indeed an additional force to help force the electrical arc, even weaker, in the arc-chute.

The invention claimed is:

1. Electromechanical circuit breaker intended to establish and break the current in a main circuit (3, 4) and comprising a fixed contact element (5) and a moving contact element (6) which in a first position are in electrical contact with each other for carrying the current of the main circuit (3, 4), said moving contact element (6) being adapted to be displaced to a second position in which it is separated from the fixed contact element (5) so that the current in the main circuit is cut off, the circuit breaker being provided with a blow-out device (2) comprising a magnetising coil (11) traversed by a magnetising current for producing a magnetic field (B) adapted to drive an arc (17) generated by the separation of said two contact elements (5, 6) into an arc extinction means (1), the blow-out device (2) comprising electrode means (9, 10) electrically connected to the magnetising coil (11) and adapted to cooperate with said arc (17) in such a manner that the latter generates said magnetising current in the magnetising coil (11), the magnetic field (B) for driving the arc (17) being generated by the action of said arc (17), characterised by the fact that the blow-out device (2) further comprises magnetic means (15, 16) for producing a magnetic field ($B_{15}$, $B_{16}$) radially directed with respect to the arc (17) and adapted to generate a force ($F_{15}$, $F_{16}$) on the arc (17) in order to displace the latter so that the arc (17) is forced to contact the electrode means (9, 10).

2. Circuit breaker according to claim 1, characterised by the fact that the electrode means comprises a first and a second arc runners (9, 10) mounted respectively over the fixed and the moving contact elements (5, 6) and electrically connected to respectively the said fixed and moving contact elements (5, 6).

3. Circuit breaker according to claim 2, characterised in that the magnetic means comprises at least one first permanent magnet (16) placed behind the second arc runner (10) mounted on top of the movable contact element (6).

4. Circuit breaker according to claim 3, characterised in that the magnetic means further comprises a second permanent magnets (15) placed behind the first arc runner (9) mounted on top of the fixed contact element (5).

5. Circuit breaker according to claim 1, characterised by the fact that the blow-out device (2) is provided with a magnetising circuit (12) comprising at least two arms (14), said magnetic field (B) for driving the arc (17) being generated at least partially between said arms (14).

6. Circuit breaker according to claim 1, characterised by the fact that the extinction means is an arc-chute (1) mounted on the blow-out device (2).

7. Circuit breaker according to claim 1, characterized by the fact that it is provided with detection means for detecting predetermined conditions in the main circuit under which the main current has to be cut off, said detection means cooperating with an actuator (7) adapted to displace the moving contact element (6) so as to cut of said main current.

8. Circuit breaker according to claim 1, characterised in that it further comprises steel plates mounted on the electrode means (9, 10) so as to reduce the magnetic field ($B_{15}$, $B_{16}$) produced by the magnetic means (15, 16) around the said electrode means (9, 10).

9. Circuit breaker according to claim 2, characterised by the fact that the blow-out device (2) is provided with a magnetising circuit (12) comprising at least two arms (14), said magnetic field (B) for driving the arc (17) being generated at least partially between said arms (14).

10. Circuit breaker according to claim 2, characterised by the fact that the extinction means is an arc-chute (1) mounted on the blow-out device (2).

11. Circuit breaker according to claim 2, characterized by the fact that it is provided with detection means for detecting predetermined conditions in the main circuit under which the main current has to be cut off, said detection means cooperating with an actuator (7) adapted to displace the moving contact element (6) so as to cut of said main current.

12. Circuit breaker according to claim 2, characterised in that it further comprises steel plates mounted on the electrode means (9, 10) so as to reduce the magnetic field ($B_{15}$, $B_{16}$) produced by the magnetic means (15, 16) around the said electrode means (9, 10).

* * * * *